US012767467B2

(12) United States Patent
Kadobayashi et al.

(10) Patent No.: US 12,767,467 B2
(45) Date of Patent: Oct. 20, 2026

(54) SHEET CONVEYING DEVICE AND IMAGE PROCESSING APPARATUS INCLUDING SHEET CONVEYING DEVICE

(71) Applicant: KYOCERA Document Solutions Inc., Osaka (JP)

(72) Inventors: Mizue Kadobayashi, Osaka (JP); Koji Fujii, Osaka (JP); Yukio Tanisaki, Osaka (JP); Ryo Kawaoka, Osaka (JP); Takafumi Nakagawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 19/007,338

(22) Filed: Dec. 31, 2024

(65) Prior Publication Data

US 2025/0230003 A1 Jul. 17, 2025

(30) Foreign Application Priority Data

Jan. 12, 2024 (JP) ..... 2024-003252

(51) Int. Cl.
*B65H 7/06* (2006.01)
*B65H 1/04* (2006.01)
(Continued)

(52) U.S. Cl.
CPC ..... *B65H 7/06* (2013.01); *B65H 1/04* (2013.01); *B65H 1/14* (2013.01); *B65H 7/14* (2013.01);
(Continued)

(58) Field of Classification Search
CPC ..... B65H 7/06; B65H 7/14; B65H 1/04
See application file for complete search history.

(56) References Cited

U.S. PATENT DOCUMENTS 10,513,402 B2 * 12/2019 Kondou ..... B65H 1/14
11,332,332 B2 * 5/2022 Shimosaka ..... B65H 7/06
(Continued)

FOREIGN PATENT DOCUMENTS

JP 2012062202 A 3/2012
JP 2022095258 A 6/2022

OTHER PUBLICATIONS

European Patent Office, Extended European Search Report Issued in Application No. 24223429.2, Jun. 3, 2025, 8 pages.

*Primary Examiner* — Patrick Cicchino
(74) *Attorney, Agent, or Firm* — Alleman Hall LLP

(57) ABSTRACT

A sheet conveying device according to this disclosure includes a conveying tray onto which a sheet is loaded, a conveying mechanism, a raising and lowering mechanism, a raising and lowering control portion, a sensor, a first determination processing portion, and a second determination processing portion. The raising and lowering control portion drives the drive portion and controls raising and lowering of the conveying tray. The first determination processing portion determines on the basis of an output signal of the sensor whether or not a foreign object other than the sheet is present on the conveying tray while the raising and lowering control portion is raising the conveying tray before the conveying mechanism conveys the sheet. The second determination processing portion determines, on the basis that the output signal of the sensor changes while the conveying mechanism is conveying the sheet, that the sheet being conveyed is abnormal.

4 Claims, 9 Drawing Sheets

(51) Int. Cl.

| | |
|---|---|
| ***B65H 1/14*** | (2006.01) |
| ***B65H 7/14*** | (2006.01) |
| *B65H 29/50* | (2006.01) |

(52) U.S. Cl.
CPC ..... *B65H 29/50* (2013.01); *B65H 2511/521* (2013.01); *B65H 2513/52* (2013.01); *B65H 2801/39* (2013.01)

(56) References Cited

U.S. PATENT DOCUMENTS

| | | | | |
|---|---|---|---|---|
| 12,540,048 | B2 * | 2/2026 | Ito | B65H 7/06 |
| 2014/0210152 | A1 * | 7/2014 | Kakuta | B65H 9/006 271/3.16 |
| 2017/0355539 | A1 * | 12/2017 | Yoshiwara | H04N 1/00777 |
| 2022/0185606 | A1 | 6/2022 | Hagihara | |
| 2024/0388667 | A1 * | 11/2024 | Kawaoka | H04N 1/00734 |

* cited by examiner

SHEET CONVEYING DEVICE AND IMAGE PROCESSING APPARATUS INCLUDING SHEET CONVEYING DEVICE

INCORPORATION BY REFERENCE

This application is based upon and claims the benefit of priority from the corresponding Japanese Patent Application No. 2024-003252 filed on Jan. 12, 2024, the entire contents of which are incorporated herein by reference.

BACKGROUND

This disclosure relates to a sheet conveying device that conveys a sheet.

A document sheet conveying device that conveys a document sheet (sheet) to the reading position of an image reading apparatus has been known. The document sheet conveying device includes, for example, a conveying tray onto which a document sheet is loaded, a discharge tray provided below the conveying tray, and a conveying mechanism that conveys the document sheet along a conveyance path extending from the conveying tray to the discharge tray through the reading position of the image reading apparatus. A sheet discharge port is formed at the downstream end of the conveyance path in the conveyance direction. The document sheet is discharged to the discharge tray from the sheet discharge port.

A document sheet conveying device capable of raising and lowering a paper feed tray to a position corresponding to the thickness of a document sheet placed on a conveying tray or the number of document sheets placed on the conveying tray is disclosed as an example of the document sheet conveying device.

SUMMARY

A sheet conveying device according to an aspect of this disclosure includes a conveying tray onto which a sheet is loaded, a conveying mechanism, a raising and lowering mechanism, a raising and lowering control portion, a sensor, a first determination processing portion, and a second determination processing portion. The conveying mechanism conveys the sheet along a conveyance path extending from the conveying tray to a discharge tray. The raising and lowering mechanism includes a drive portion that raises and lowers the conveying tray in an up-down direction. The raising and lowering control portion drives the drive portion and controls raising and lowering of the conveying tray. The sensor detects that a downstream end of a sheet in a conveying direction flips up. The sheet is conveyed from the conveying tray. The first determination processing portion determines on the basis of an output signal of the sensor whether or not a foreign object other than the sheet is present on the conveying tray while the raising and lowering control portion is raising the conveying tray before the conveying mechanism conveys the sheet. The second determination processing portion determines, on the basis that the output signal of the sensor changes while the conveying mechanism is conveying the sheet, that the sheet being conveyed is abnormal.

An image processing apparatus according to another aspect of this disclosure includes the sheet conveying device, and an image processing portion configured to perform an image process on a sheet that is conveyed by the sheet conveying device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of this disclosure will be described with reference where appropriate to the drawings. It is to be noted that an embodiment described below is merely a specific example of this disclosure and does not limit the technical scope of this disclosure.

Figure 1:
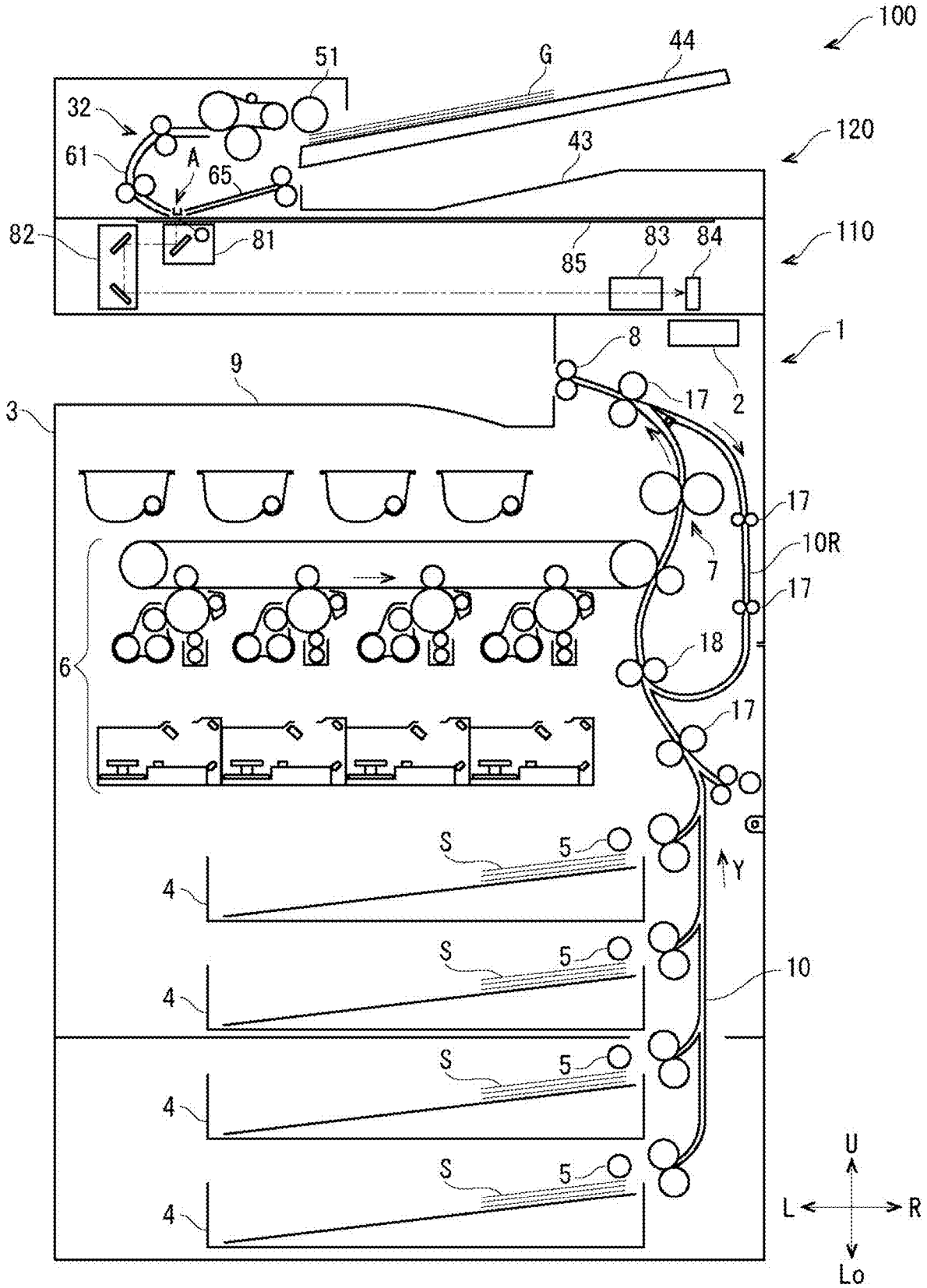
FIG. 1 is a diagram schematically showing an internal configuration of an image forming apparatus according to an embodiment of this disclosure.

FIG. 1 is a diagram showing the internal configuration of an image forming apparatus 100 including a document sheet conveying device 120 according to an embodiment of this disclosure. It is to be noted that the document sheet conveying device 120 is an example of a sheet conveying device according to this disclosure. In addition, the image forming apparatus 100 is an example of an image processing apparatus according to this disclosure.

The foreground side of FIG. 1 will be used as the front (front side) of the image forming apparatus 100 below. The left and right directions will be described on the basis of the directions defined when the image forming apparatus 100 is viewed from the front. In addition, U, Lo, L, R, Fr, and Rr will respectively represent up, down, left, right, front, and rear in each of the diagrams.

The image forming apparatus 100 includes a printer 1, the document sheet conveying device 120 that conveys a document sheet G (an example of a sheet according to this disclosure), a scanner 110 (an example of an image processing portion according to this disclosure) that performs an image reading process on the document sheet G, and a control portion 2 that integrally controls them. The scanner 110 is provided above the printer 1. The document sheet conveying device 120 is provided above the scanner 110. The document sheet conveying device 120 conveys the document sheet G through a reading position A of the scanner 110. The scanner 110 is a flatbed image scanner. The scanner 110 reads an image on the document sheet G and generates image data. The printer 1 forms an image based on the image data on a sheet S. In this embodiment, an example is demonstrated in which the printer 1 forms an image in an electrophotographic method, but the printer 1 may be configured to form an image in another method (e.g., ink-jet method).

It is to be noted that the image processing apparatus according to this disclosure may be an image reading apparatus including the document sheet conveying device 120 and the scanner 110.

The printer 1 includes a body housing 3 having a rectangular-parallelepiped shape. The lower portion of the inside of the body housing 3 is provided with a sheet feed cassette 4 in which the sheet S is stored and a sheet feed roller 5 that sends the sheet S to the right from the sheet feed cassette 4. An image forming device 6 that forms a toner image in an electrophotographic method is provided above the sheet feed cassette 4. A fixing device 7 that fixes the toner image onto the sheet S is provided above and to the right of the image forming device 6. A discharge roller 8 that discharges the sheet S onto which the toner image is fixed and a discharge tray 9 onto which the discharged sheet S is loaded are provided above the fixing device 7.

The inside of the body housing 3 is provided with a conveyance path 10 extending from the sheet feed roller 5 to the discharge roller 8 through the image forming device 6 and the fixing device 7. The conveyance path 10 is formed by using, as main members, plate-shaped members opposed to each other with a gap in between that allows the sheet S to pass therethrough. A plurality of conveying rollers 17 that pinches and conveys the sheet S is provided along the conveyance path 10 at appropriate intervals. A registration roller 18 is provided on the upstream side of the image forming device 6 in a conveyance direction Y. An inverting conveyance path 10R is provided to the right of the fixing device 7. The inverting conveyance path 10R branches from the conveyance path 10 on the downstream side of the fixing device 7 in the conveyance direction Y and merges with the conveyance path 10 on the upstream side of the registration roller 18 in the conveyance direction Y.

A display operation portion (not shown) is provided on the front side of the scanner 110. The display operation portion includes a display panel, a touch panel provided to be overlaid on the display surface of the display panel, and a keypad adjacent to the display panel (not shown).

The control portion 2 controls an operation of the image forming apparatus 100. The control portion 2 causes the display panel to display a screen indicating the operation menus, the statuses, and the like of the printer 1 and the scanner 110 and controls the respective portions of the printer 1, the scanner 110, and the document sheet conveying device 120 in accordance with operations detected by the touch panel and the keypad.

A basic image forming operation of the printer 1 is as follows. When the printer 1 receives a print job for single-sided printing from the display operation portion, an external computer, or the like, the sheet feed roller 5 sends the sheet S to the conveyance path 10 from the sheet feed cassette 4, the registration roller 18 that stops rotating corrects a skew of the sheet S, and the registration roller 18 sends the sheet S to the image forming device 6 at a predetermined timing. The image forming device 6 forms a toner image on the sheet S in an electrophotographic method. Subsequently, the fixing device 7 fixes the toner image onto the sheet S by fusing the toner image while pinching and conveying the sheet S. The discharge roller 8 discharges the sheet S to the discharge tray 9. In the case of double-sided printing, the sheet S having the toner image fixed onto a first side is sent to the conveyance path 10 through the inverting conveyance path 10R, thereby transferring the toner image onto a second side.

Scanner 110

The scanner 110 includes a first carriage 81 including a light source and a reflecting mirror, a second carriage 82 including two reflecting mirrors, a lens 83 that causes light to form an image, an imaging element 84 that converts the light which forms an image to image data, and a contact glass 85 on which the document sheet G is placed.

A basic document sheet reading operation of the scanner 110 is as follows. When a user puts the document sheet G on the upper surface of the contact glass 85 and gives a reading instruction to the scanner 110, the second carriage 82 moves to the right at speed V/2 in association with the first carriage 81 moving to the right at speed V. While the second carriage 82 is moving, the light source irradiates the document sheet G with light, reflection light reflected by the document sheet G is guided to the lens 83 by being reflected by the reflecting mirror of the first carriage 81 and the reflecting mirrors of the second carriage 82, and the reflection light forms an image on the imaging element 84 and is converted to an image signal. The image signal is output to the control portion 2 of the image forming apparatus 100 and converted to image data.

In addition, when a user places the one or more document sheets G on a paper feed tray 44 and gives a reading instruction to the scanner 110, the scanner 110 starts to convey the document sheets G by the document sheet conveying device 120 with the first carriage 81 disposed at a home position below the reading position A. Then, when the document sheet G being conveyed passes by the reading position A, the light source irradiates the document sheet G with light, reflection light reflected by the document sheet G is guided to the lens 83 by being reflected by the reflecting mirror of the first carriage 81 and the reflecting mirrors of the second carriage 82, and the reflection light forms an image on the imaging element 84 and is converted to an image signal. The image signal is output to the control portion 2 of the image forming apparatus 100 and converted to image data.

Document Sheet Conveying Device 120

Figure 2:
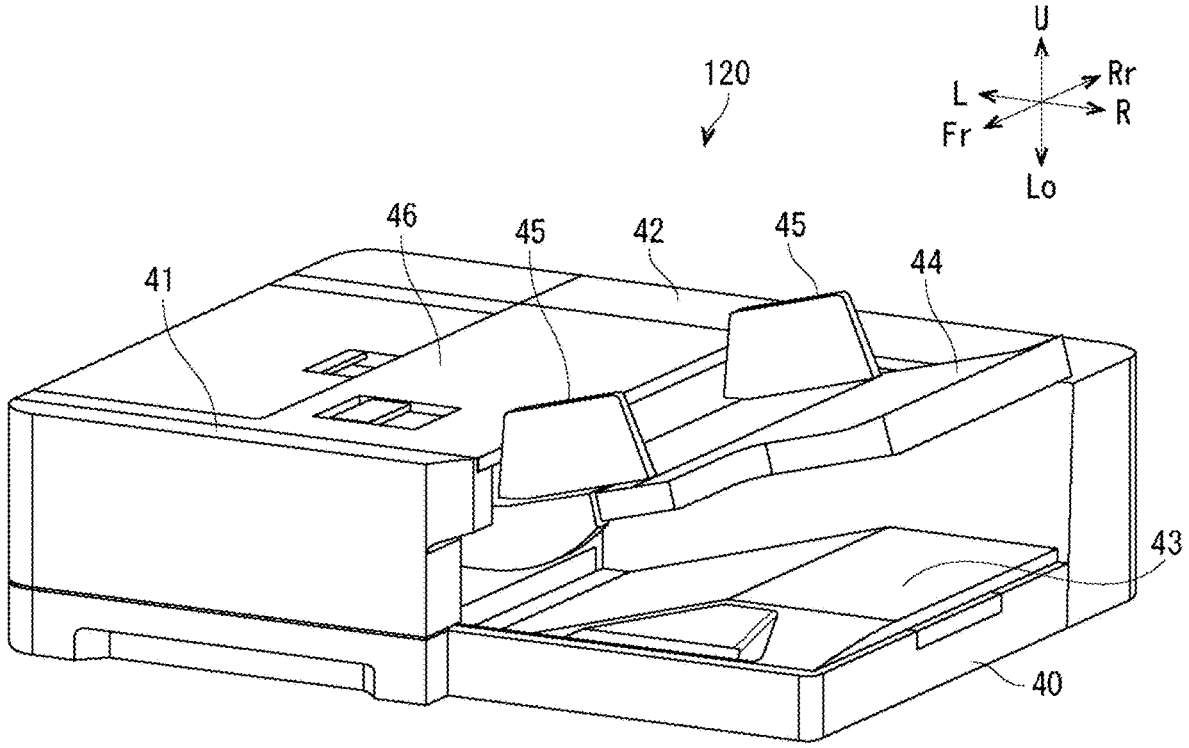
FIG. 2 is a perspective view of external appearance of a document sheet conveying device according to an embodiment of this disclosure.

Next, the document sheet conveying device 120 will be described. FIG. 2 is a perspective view of the external appearance of the document sheet conveying device 120.

Figure 3:
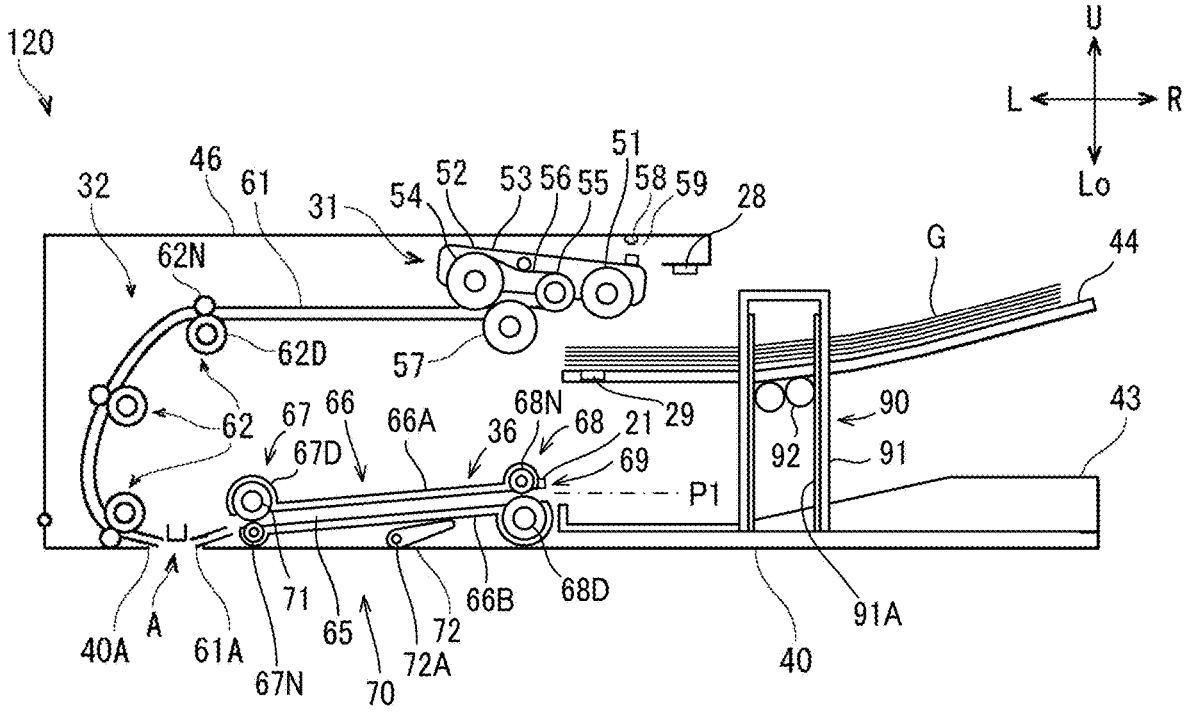
FIG. 3 is a diagram schematically showing an internal configuration of the document sheet conveying device according to the embodiment of this disclosure and shows a state in which a paper feed tray is disposed at an initial position.
Figure 4:
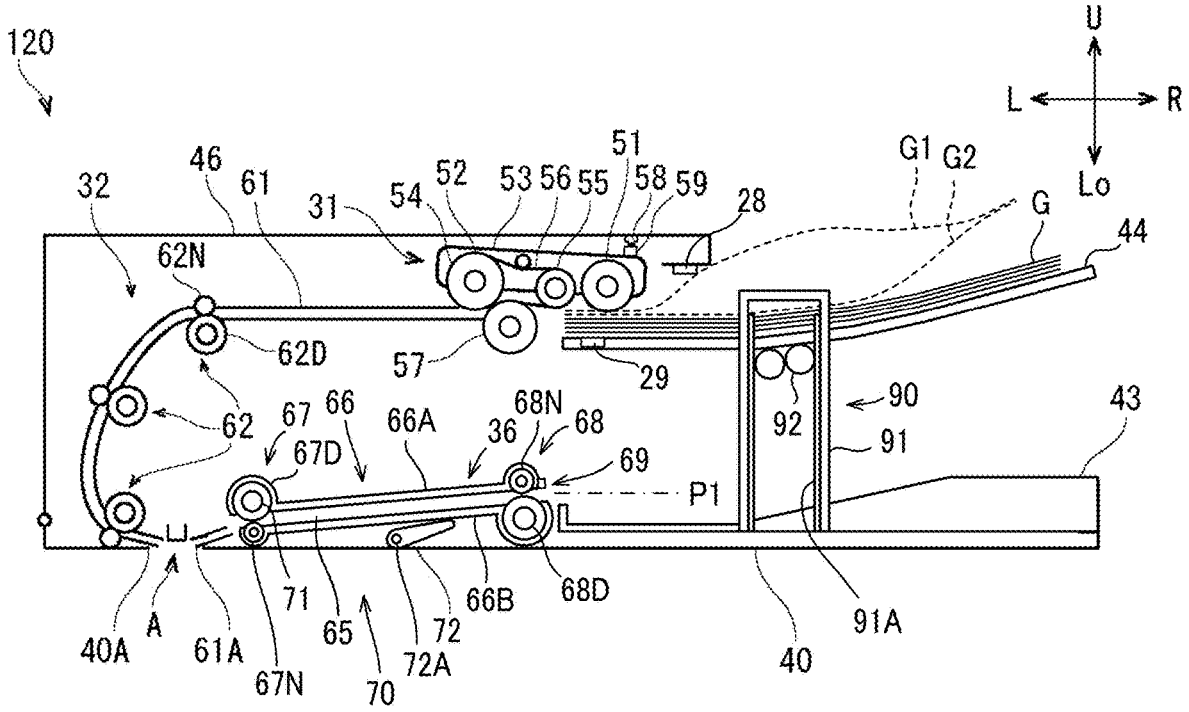
FIG. 4 is a diagram schematically showing the internal configuration of the document sheet conveying device according to the embodiment of this disclosure and shows a state in which the paper feed tray is raised from the initial position and disposed at a conveying position.
Figure 5:
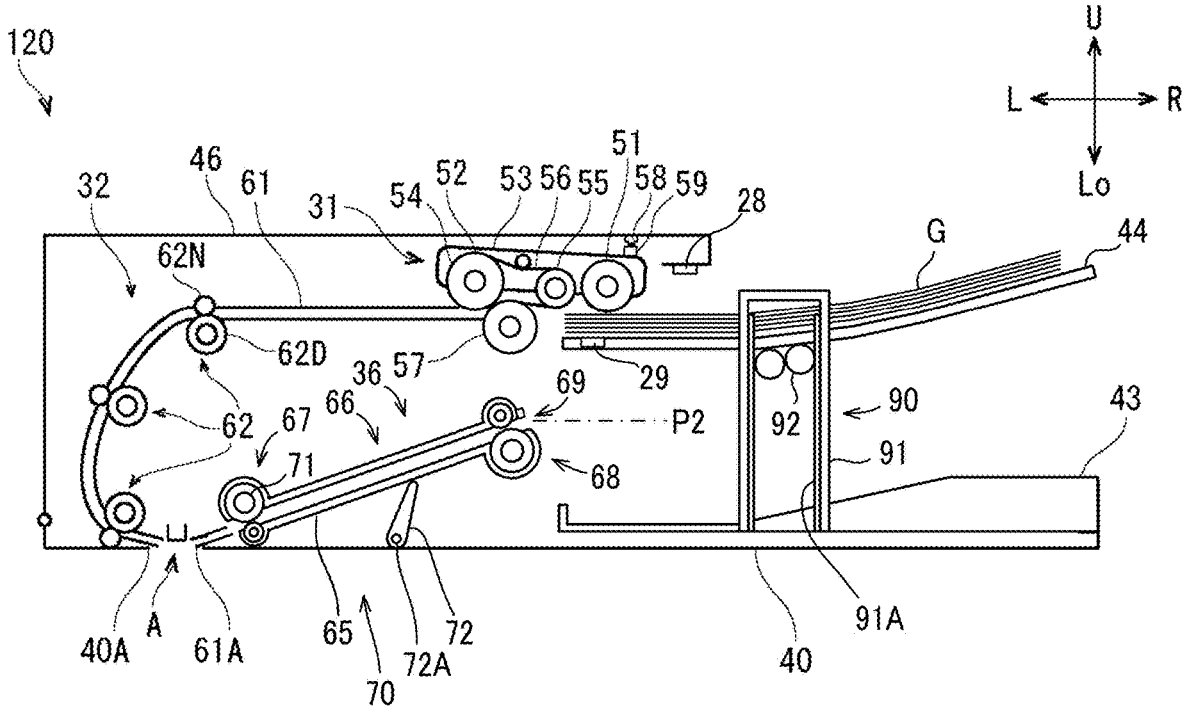
FIG. 5 is a diagram schematically showing the internal configuration of the document sheet conveying device according to the embodiment of this disclosure and shows a state in which a discharge guide portion is disposed at a dischargeable position.

Each of FIGS. 3 to 5 is a diagram schematically showing the internal configuration of the document sheet conveying device 120. Here, FIG. 3 shows a state in which the paper feed tray 44 described below is disposed at an initial position. FIG. 4 shows a state in which the paper feed tray 44 is raised from the initial position and disposed at a conveying position. FIG. 5 shows a state in which a discharge guide portion 66 is disposed at a dischargeable position that allows the document sheet G to be discharged.

The document sheet conveying device 120 includes the paper feed tray 44 (an example of a conveying tray according to this disclosure), a sheet discharge tray 43 (an example of a discharge tray according to this disclosure), a sheet feed mechanism 31, a conveying mechanism 32, a discharge mechanism 36, a first raising and lowering mechanism 90 (an example of a raising and lowering mechanism according to this disclosure), a second raising and lowering mechanism 70, a holder detection sensor 58, a document sheet detection sensor 29, a swing driving amount measurement portion 16 (see FIG. 6), and a discharged document sheet sensor 21. The sheet feed mechanism 31, the conveying mechanism 32, and the discharge mechanism 36 are examples of conveying mechanisms according to this disclosure that each convey a document sheet from the paper feed tray 44 to the sheet discharge tray 43.

In this embodiment, the control portion 2 (see FIG. 1) calculates the height position of the upper surface of the document sheet G on the basis of the distance to the upper surface of the document sheet G on the sheet discharge tray 43 measured by an upper surface distance measurement portion 19. The control portion 2 performs control by causing the second raising and lowering mechanism 70 to move the discharge guide portion 66 of the discharge mechanism 36 in the up-down direction depending on the height position such that the difference between a discharge port 69 and the upper surface of the document sheet G loaded onto the sheet discharge tray 43 falls within a predetermined range.

As shown in FIGS. 2 and 3, the document sheet conveying device 120 includes a substantially rectangular bottom 40 formed to have a flat shape, and a first wall portion 41 and a second wall portion 42 opposed to each other in the front-back direction (the width direction crossing a conveyance direction Z of the document sheet G). The rear edge of the bottom 40 is coupled to the rear of the contact glass 85 (see FIG. 1) of the scanner 110 by a hinge. The bottom 40 also has a function of a holding plate that holds the document sheet G on the contact glass 85. The first wall portion 41 is provided from the left end to the middle of the front edge of the bottom 40. The second wall portion 42 is provided to the whole of the rear edge of the bottom 40. A cover portion 46 covers the upper portion and the left side portion of the space between the first wall portion 41 and the second wall portion 42. The lower left end of the cover portion 46 is coupled to the left end of the bottom 40 by a hinge.

Paper Feed Tray 44

The paper feed tray 44 is a document sheet placing portion on which the document sheet G to be conveyed is placed. The paper feed tray 44 is provided closer to the right than the middle of the document sheet conveying device 120 in the left-right direction and closer to the front than the second wall portion 42. The document sheet G to be conveyed is placed on the paper feed tray 44. The paper feed tray 44 is a plate-shaped member that is inclined such that the left side of the plate-shaped member is lower. A plate-shaped cover frame (not shown) that prevents a retard roller 57 from being exposed to the lower side is provided to the left of the left end of the paper feed tray 44. The retard roller 57 will be described below. Both the front and rear ends of the cover frame are fixed to the first wall portion 41 and the second wall portion 42 (see FIG. 2). The right end of the cover frame is provided with a sheet feed wall portion (not shown) extending in the up-down direction. This sheet feed wall portion restricts the movement of the document sheet G loaded onto the paper feed tray 44 to the left. It is to be noted that a cover frame 47 may be a holder which holds the retard roller 57 from the lower side.

The upper surface of the paper feed tray 44 is provided with a pair of cursors 45 that aligns the ends of the document sheets G in the front-back direction. The cursors 45 are each slidable in the front-back direction.

Sheet Discharge Tray 43

The sheet discharge tray 43 is a document sheet storing portion that stores the document sheet G discharged through a conveyance path 61 and a discharge path 65 by having the document sheet G loaded thereon. The sheet discharge tray 43 is provided below the paper feed tray 44. The sheet discharge tray 43 is integrated with the bottom 40. The middle of the sheet discharge tray 43 in the left-right direction is provided with an inclined surface that is inclined such that the left side of the inclined surface is lower.

Sheet Feed Mechanism 31

The sheet feed mechanism 31 takes out the document sheets G placed on the paper feed tray 44 one by one and conveys the document sheets G to the conveyance path 61. As shown in FIG. 3, the sheet feed mechanism 31 is provided in the space between the first wall portion 41 and the second wall portion 42. The sheet feed mechanism 31 includes a box-shaped holder 53 the lower portion of which is open. A feed roller 51, a driven roller 55, a drive roller 52, an endless belt 56, and the retard roller 57 are disposed inside the holder 53 with the front-back direction as an axial direction. The driven roller 55 is provided to the left of the feed roller 51. The drive roller 52 is provided to the left of the driven roller 55. The endless belt 56 is wound around the drive roller 52 and the driven roller 55. The retard roller 57 is pressed against the lower surface of the lower portion of the endless belt 56.

Both the front and rear ends of a drive shaft 54 of the drive roller 52 are supported by the first wall portion 41 and the second wall portion 42. The drive shaft 54 is connected to a drive portion (not shown) including a motor and a reduction gear. The holder 53 is supported by the drive shaft 54 and is swingable around the drive shaft 54. The driving force of the drive shaft 54 is transmitted to the feed roller 51 and the retard roller 57 by a transmission mechanism (not shown) such as a gear train and an endless belt.

Holder Detection Sensor 58

The holder detection sensor 58 is provided on the inner surface of the cover portion 46. The holder detection sensor 58 is used to determine whether or not the paper feed tray 44 is disposed at a position (conveying position) that allows the placed document sheet G to be conveyed. The holder detection sensor 58 is, for example, a transmissive or reflective optical sensor. In a case where the holder detection sensor 58 is a transmissive optical sensor, the upper portion of the holder 53 is provided with a light shielding plate 59 that protrudes upward or sideward. In addition, in a case where the holder detection sensor 58 is a reflective optical sensor, the upper portion of the holder 53 is provided with a reflecting plate.

In a case where the document sheet G is not placed on the paper feed tray 44, the holder 53 keeps a first attitude (the attitude shown in FIG. 3) at which the roller surface of the feed roller 51 is brought the closest to the upper surface of the paper feed tray 44. When the one or more document sheets G are placed on the paper feed tray 44 and the document sheets G are detected by the document sheet detection sensor 29, the control portion 2 controls the driving of the first raising and lowering mechanism 90 and raises the paper feed tray 44 from the initial position. When the upper surface of the document sheets G on the paper feed tray 44 then abuts the feed roller 51 and the holder 53 is pressed against the upper side while the paper feed tray 44 is being raised, the feed roller 51 is held up and this also displaces the holder 53 upward.

In a case where the holder detection sensor 58 is a transmissive optical sensor, the upward displacement of the holder 53 causes the light shielding plate 59 to enter the sensing region of the holder detection sensor 58. It is proportional to the quantity of document sheets G placed on the paper feed tray 44 how much the light shielding plate 59 enters the sensing region. The holder detection sensor 58 outputs, to the control portion 2, a document sheet sense signal having the signal level corresponding to how much the light shielding plate 59 enters the sensing region. The control portion 2 determines on the basis of the signal level of the document sheet sense signal whether or not the paper feed tray 44 is located at the conveying position.

Specifically, in a case where the signal level of the document sheet sense signal falls below a predetermined threshold, the control portion 2 determines that the paper feed tray 44 reaches the conveying position. Then, in a case where it is determined that the paper feed tray 44 is located at the conveying position, the control portion 2 stops raising the paper feed tray 44. This keeps the paper feed tray 44 at the conveying position. When the document sheets G on the paper feed tray 44 are conveyed and decreased, the holder 53 is displaced downward by the weight of the holder 53. This increases the signal level of the document sheet sense signal to the threshold or more. In this case, the control portion 2 controls the driving of the first raising and lowering mechanism 90 again and raises the paper feed tray 44. When the signal level of the document sheet sense signal falls below the predetermined threshold, the control portion 2 stops the paper feed tray 44.

Document Sheet Detection Sensor 29

The document sheet detection sensor 29 (see FIG. 3) detects the presence or absence of the document sheet G on the paper feed tray 44. The document sheet detection sensor 29 is provided to the paper feed tray 44. The document sheet detection sensor 29 is a reflective light sensor including, for example, a light emitting element and a light receiving element. The document sheet detection sensor 29 is disposed near the downstream end of the upper surface of the paper feed tray 44 in the conveying direction. In a case where the document sheet G is placed on the paper feed tray 44, light emitted from the light emitting element is reflected by the document sheet G. When the reflected light is received by the light receiving element, the document sheet detection sensor 29 outputs an ON-signal to the control portion 2 as a sense signal indicating that the document sheet G is detected. In contrast, in a case where the document sheet G is not placed on the paper feed tray 44, the light emitted from the light emitting element is not reflected by the document sheet G and is not thus received by the light receiving element. The document sheet detection sensor 29 outputs an OFF-signal to the control portion 2 as a sense signal indicating that the document sheet G is not detected. The control portion 2 determines the presence or absence of the document sheet G on the paper feed tray 44 on the basis of the sense signal output from the document sheet detection sensor 29.

First Raising and Lowering Mechanism 90

The first raising and lowering mechanism 90 has a function of raising and lowering the paper feed tray 44. The first raising and lowering mechanism 90 raises and lowers the paper feed tray 44 between the initial position (the position shown in FIG. 3) that is the lowermost position and the conveying position (the position shown in FIG. 4). As shown in FIG. 2, the first raising and lowering mechanism 90 includes a rack 91, a pinion 92, and a drive portion 93 (see FIG. 6) such as a motor. In this embodiment, the pair of racks 91 and the pair of pinions 92 are provided on both the front and rear sides across the sheet feed mechanism 31. It is to be noted that FIGS. 3 to 5 each show only the rack 91 and the pinion 92 on the front side.

The rack 91 is fixed to a side portion of a frame (not shown) that supports the sheet feed mechanism 31, the conveying mechanism 32, the discharge mechanism 36, and the like. The pinion 92 is supported by a side portion of the paper feed tray 44 so as to be axially rotatable. The pair of left and right pinions 92 is linked by a shaft (not shown). One of the pinions 92 is connected to the output shaft of the drive portion 93 (see FIG. 6) through a power transmission mechanism such as a gear train. For example, the rack 91 is formed to have a substantially inverted U shape including an internal tooth 91A. The pinion 92 is engaged with the internal tooth of the rack 91. The drive portion 93 is electrically connected to the control portion 2. The pinion 92 is rotationally driven by the drive portion 93, thereby moving in the up-down direction while engaging with the rack 91. This moves the paper feed tray 44 in the same direction as the movement direction of the pinion 92 along with the movement of the pinion 92.

It is to be noted that the discharge guide portion 66 of the discharge mechanism 36 described below is configured to be movable in the up-down direction by the second raising and lowering mechanism 70 in this embodiment. For example, a link member (not shown) that links the paper feed tray 44 and the discharge guide portion 66 together may be, however, provided instead of the second raising and lowering mechanism 70 and the discharge guide portion 66 may be moved in the up-down direction in association with the movement of the paper feed tray 44 in the up-down direction.

Flip-up Detection Sensor 28

A flip-up detection sensor 28 is provided on the lower surface of the right end of the cover portion 46. The flip-up detection sensor 28 is a sensor that detects that the rear end of the document sheet G flips up while the document sheet G is being conveyed. In addition, the flip-up detection sensor 28 is also used as a sensor that detects a foreign object on the paper feed tray 44.

For example, in a case where an uppermost document sheet G1 and a next document sheet G2 placed on the paper feed tray 44 are bound by a staple, a conveying operation performed on the document sheet G1 causes the bound portion at the rear end to be pulled and flip up. The document sheet G1 is held higher than a normal position at the time of sheet feeding (see a dashed line in FIG. 4). The flip-up detection sensor 28 is provided to detect the document sheet G1 in such a state.

The flip-up detection sensor 28 is a reflective light sensor including, for example, a light emitting element and a light receiving element. The flip-up detection sensor 28 causes the light emitting element to emit light to the upper surface of the document sheet G1 placed on the paper feed tray 44. The light emitted from the light emitting element is reflected by the document sheet G1. When the reflected light is received by the light receiving element, the flip-up detection sensor 28 outputs, to the control portion 2, a sense signal having the signal level corresponding to the amount of received light. The signal level grows higher as the interval between the flip-up detection sensor 28 and the document sheet G1 is shorter. The signal level grows lower as this interval is longer.

In this embodiment, in a case where a surface of the document sheet G1 comes closer to the flip-up detection sensor 28 and the interval therebetween falls below a predetermined distance, the flip-up detection sensor 28 outputs an ON-signal (HIGH-level signal) having a signal level greater than or equal to a predetermined threshold to the control portion 2. In addition, in a case where the surface of the document sheet G1 is apart from the flip-up detection sensor 28 by the predetermined interval or more, the flip-up detection sensor 28 outputs an OFF-signal (LOW-level signal) having a signal level less than the predetermined threshold to the control portion 2.

While the document sheet G is being conveyed, the control portion 2 determines on the basis of the signal level of the sense signal from the flip-up detection sensor 28 whether or not the document sheet G1 is flipping up. Specifically, the control portion 2 acquires the sense signal immediately after the document sheet G1 starts to be conveyed. In a case where the sense signal is the ON-signal, the control portion 2 determines that the document sheet G1 is flipping up. Then, in a case where it is determined that the document sheet G1 is flipping up, the control portion 2 stops the sheet feed mechanism 31 performing the conveying operation on the document sheet G1. This, for example, prevents the document sheet G1 and the document sheet G2 from being damaged, prevents a paper jam in the document sheet conveying device 120, and prevents the staple from damaging each of the rollers. In addition, in a case where the sense signal is the OFF-signal, the control portion 2 determines that the document sheet G1 is not flipping up. In this case, the control portion 2 causes the sheet feed mechanism 31 to keep the conveying operation on the document sheet G1.

In addition, in a case where a foreign object is present on the upper surface of the uppermost document sheet G1 on the paper feed tray 44, and the foreign object comes closer to the flip-up detection sensor 28 and the interval therebetween falls below the predetermined distance, the flip-up detection sensor 28 also outputs the ON-signal (HIGH-level signal) to the control portion 2. It is to be noted that, in a case where no foreign object is present on the upper surface of the document sheet G1, the flip-up detection sensor 28 outputs the OFF-signal (LOW-level signal) to the control portion 2.

While the paper feed tray 44 is being raised from the initial position before the document sheet G is conveyed, the control portion 2 determines on the basis of the signal level of the sense signal from the flip-up detection sensor 28 whether or not a foreign object is present on the upper surface of the document sheet G on the paper feed tray 44. Specifically, the control portion 2 acquires the sense signal while the paper feed tray 44 is being raised. In a case where the sense signal is the ON-signal, the control portion 2 determines that a foreign object is present.

Conveying Mechanism 32

The conveying mechanism 32 further conveys the document sheet G sent by the sheet feed mechanism 31 to the downstream side in the conveyance direction. The conveying mechanism 32 includes the conveyance path 61 formed to have a curved shape like U that extends above and to the right of an opening 40A from the sheet feed mechanism 31 through the opening 40A and a plurality of conveying roller pairs 62 disposed along the conveyance path 61.

The conveyance path 61 is formed by using, as main members, plate-shaped members opposed to each other with a gap in between that allows the document sheet G to pass therethrough. The opening 40A is provided in a region opposed to the first carriage 81 (see FIG. 1) located at the home position in the bottom 40. The opening 40A is a slit having the front-back direction as a longitudinal direction. The opening 40A is an example of the reading position A that is a position at which the scanner 110 reads the document sheet G. At the reading position A, a plate-shaped member below the conveyance path 61 is provided with an opening 61A corresponding to the opening 40A. The lower surface of the document sheet G being conveyed is exposed to the lower side through the opening 40A and the opening 61A.

The conveying roller pairs 62 each include a drive roller 62D and a driven roller 62N. A drive portion (not shown) including a motor and a reduction gear is connected to the shaft of each drive roller 62D. When the motors of the drive portions are driven, the plurality of conveying roller pairs 62 also rotate in synchronization.

Discharge Mechanism 36

The discharge mechanism 36 further conveys the document sheet G conveyed through the conveyance path 61 to the downstream side in the conveyance direction and discharges the document sheet G to the sheet discharge tray 43. The discharge mechanism 36 includes the discharge path 65 extending to the sheet discharge tray 43 from the region near the downstream end of the conveyance path 61 in the conveyance direction, the discharge guide portion 66 (an example of a discharge guide according to this disclosure) that forms the discharge path 65, a conveying roller pair 67 disposed at the upstream end of the discharge path 65 in the conveyance direction, and a discharge roller pair 68 disposed at the downstream end of the discharge path 65 in the conveyance direction.

The discharge guide portion 66 extends to the upstream side in the conveyance direction from the discharge port 69 that is open at the downstream end of the discharge path 65 and reaches the region near the opening 61A.

The discharge path 65 is formed by using the discharge guide portion 66 having a gap that allows the document sheet G to pass therethrough. The discharge guide portion 66 includes plate-shaped guide members 66A and 66B provided with the gap and opposed to each other.

The conveying roller pair 67 is supported by the upstream end of each of the guide members 66A and 66B in the conveyance direction so as to be rotatable. The discharge roller pair 68 is supported by the downstream end of each of the guide members 66A and 66B in the conveyance direction so as to be rotatable. The conveying roller pair 67 includes a drive roller 67D supported by the upper guide member 66A and a driven roller 67N supported by the lower guide member 66B. The discharge roller pair 68 includes a driven roller 68N supported by the guide member 66A and a drive roller 68D supported by the guide member 66B. The drive rollers 67D and 68D are each connected to a drive portion (not shown) including a motor and a reduction gear. The discharge port 69 from which the document sheet G is discharged is formed in the contact region of the drive roller 68D and the driven roller 68N of the discharge roller pair 68.

Second Raising and Lowering Mechanism 70

The second raising and lowering mechanism 70 is a mechanism that raises and lowers the discharge guide portion 66 in the up-down direction along with the discharge mechanism 36. The second raising and lowering mechanism 70 includes a swing shaft 71, an eccentric cam 72, and a drive portion 73 (see FIG. 6). The swing shaft 71 is provided at the upstream end of the discharge path 65 in the conveyance direction with the front-back direction as an axial direction. In this embodiment, the drive shaft of the conveying roller pair 67 also serves as the swing shaft 71, but the driven shaft of the conveying roller pair 67 may also serve as the swing shaft 71. The swing shaft 71 different from the drive shaft and the driven shaft of the conveying roller pair 67 may be provided to the guide members 66A and 66B. The eccentric cam 72 is rotatable around a cam shaft 72A having the front-back direction as an axial direction. The drive portion 73 is a driving source such as a motor. The cam shaft 72A is connected to the output shaft of the drive portion 73. The slide surface of the eccentric cam 72 is in contact with the lower surface of the lower guide member 66B.

When, for example, driving force in the forward rotation direction is input to the cam shaft 72A from the drive portion 73, the eccentric cam 72 rotates in the forward rotation direction upon receiving the driving force. The eccentric cam 72 applies force through this rotation operation in the direction in which the discharge mechanism 36 is pushed up. This swings the discharge mechanism 36 around the swing shaft 71 in the up-down direction. The position of the discharge port 69 is moved in the up direction through this swing operation. In addition, when, for example, driving force in the reverse rotation direction is input to the cam shaft 72A from the drive portion 73, the eccentric cam 72 rotates in the reverse rotation direction upon receiving the driving force. The eccentric cam 72 rotates through this rotation operation in the direction in which the eccentric cam 72 goes away from the discharge mechanism 36. This swings the discharge mechanism 36 around the swing shaft 71 in the down direction because of the weight of the discharge mechanism 36. The position of the discharge port 69 is moved in the down direction through this swing operation.

Swing Driving Amount Measurement Portion 16

The swing driving amount measurement portion 16 (see FIG. 6) is a sensor that senses or measures the position of the discharge port 69 in the up-down direction and the amount of movement of the discharge port 69 in the up-down direction. The swing driving amount measurement portion 16 is provided to the second raising and lowering mechanism 70. The swing driving amount measurement portion 16 is, for example, an optical rotary encoder. The swing driving amount measurement portion 16 is provided to the cam shaft 72A of the eccentric cam 72. The swing driving amount measurement portion 16 outputs a pulse signal indicating the amount of rotation of the cam shaft 72A. The control portion 2 (see FIG. 1) obtains the amount of rotation by analyzing the pulse signal and calculates the position of the discharge port 69 in the up-down direction and the amount of movement of the discharge port 69 in the up-down direction on the basis of this amount of rotation. It is to be noted that the rotary encoder may be provided to the output shaft of a motor which drives the eccentric cam 72. In addition, the swing driving amount measurement portion 16 may include a computation part that calculates the position of the discharge port 69 in the up-down direction and the amount of movement of the discharge port 69 in the up-down direction on the basis of the pulse signal indicating the amount of rotation of the cam shaft 72A.

Discharged Document Sheet Sensor 21

The discharged document sheet sensor 21 is a sensor that detects the presence or absence of the document sheet G on the sheet discharge tray 43 and the quantity of document sheets G loaded onto the sheet discharge tray 43. The discharged document sheet sensor 21 is provided at the right end of the upper guide member 66A. The discharged document sheet sensor 21 is a reflective optical sensor including, for example, a light emitting element and a light receiving element. The discharged document sheet sensor 21 emits light in the right direction (toward the sheet discharge tray 43) from the light emitting element. In addition, in a case where the light emitted from the light emitting element is reflected by a side surface (left side surface) of the bundle of document sheets G on the sheet discharge tray 43, the light receiving element of the discharged document sheet sensor 21 receives the reflection light. The discharged document sheet sensor 21 outputs, to the control portion 2, an electrical signal indicating whether or not the light receiving element receives the light. Specifically, in a case where the light receiving element receives the reflection light, an ON-signal (HIGH-level signal) is output to the control portion 2. In a case where the light receiving element does not receive the reflection light, an OFF-signal (LOW-level signal) is output to the control portion 2. The control portion 2 determines the presence or absence of the document sheet G on the sheet discharge tray 43 on the basis of the signal level of the electrical signal. In addition, the control portion 2 determines the quantity of document sheets G loaded onto the sheet discharge tray 43 on the basis of the speed at which the discharge guide portion 66 is raised and the time elapsed before the signal level changes from ON to OFF after the discharge guide portion 66 starts to be raised.

Incidentally, in a case where a foreign object other than the document sheet G is present on the paper feed tray 44 in the document sheet conveying device 120 capable of raising and lowering the paper feed tray 44, the foreign object may be caught in the housing of the document sheet conveying device 120 such as the cover portion 46 or the frame and the housing may be damaged when the paper feed tray 44 is raised. In addition, the foreign object may enter the sheet feed mechanism 31, the conveying mechanism 32, the discharge mechanism 36, or the like and these mechanisms may be damaged in a process of conveying the document sheet G from the paper feed tray 44. In addition, when the foreign object enters, from the opening 40A or the opening 61A, the inside of the scanner 110 below, an optical device of the scanner 110 may be damaged.

In the document sheet conveying device 120 according to this embodiment, it is possible to easily and reliably detect the presence or absence of the foreign object on the paper feed tray 44 in a simple configuration. In particular, in the document sheet conveying device 120 having a function of detecting that the document sheet G1 flips up, it is possible to detect the presence or absence of the foreign object on the paper feed tray 44 without additionally installing any sensor that senses the foreign object.

Configuration of Control Portion 2

Figure 6:
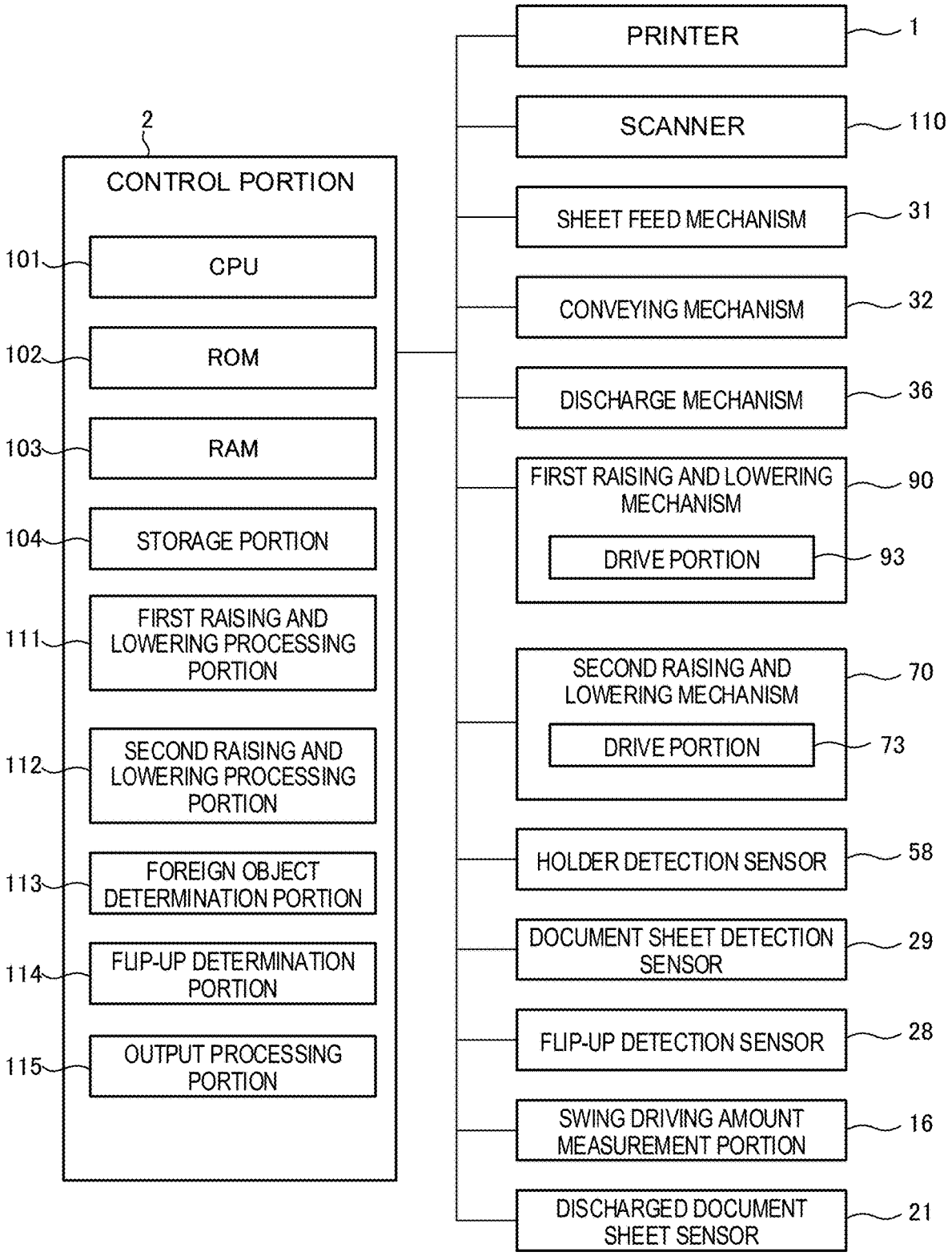
FIG. 6 is a block diagram showing a configuration of the document sheet conveying device according to an embodiment of this disclosure.

The configuration of the control portion 2 and raising and lowering control that is executed by the control portion 2 will be described with reference to FIG. 6. As shown in FIG. 6, the control portion 2 is a microcomputer including a CPU 101, a ROM 102, a RAM 103, a storage portion 104, and the like. The CPU 101 carries out various processes by reading and executing a control program stored in a storage device such as the ROM 102 or the storage portion 104. The storage portion 104 is a non-volatile storage device such as a flash memory. The storage portion 104 stores various kinds of information or data (such as positional information regarding the discharge guide portion 66, the conveyance path length of the document sheet G, or the conveyance speed of the document sheet G) to be used for the various processes. The control portion 2 may be implemented, for example, by an IC such as an ASIC without using any control program or software.

The control portion 2 integrally controls the image forming apparatus 100. The control portion 2 will be described below as what controls the document sheet conveying device 120.

As shown in FIG. 6, the control portion 2 includes various processing portions such as a first raising and lowering processing portion 111 (an example of a raising and lowering control portion according to this disclosure), a second raising and lowering processing portion 112, a foreign object determination portion 113 (an example of a first determination processing portion according to this disclosure), a flip-up determination portion 114 (an example of a second determination processing portion according to this disclosure), and an output processing portion 115 (an example of an output processing portion according to this disclosure).

The control portion 2 functions as the various processing portions by executing the various processes compliant with the control program with the CPU 101.

The first raising and lowering processing portion 111 drives the drive portion 93 of the first raising and lowering mechanism 90 and controls the raising and lowering of the paper feed tray 44.

Before the sheet feed mechanism 31 conveys the document sheet G on the paper feed tray 44, the foreign object determination portion 113 determines whether or not a foreign object other than the document sheet G is present on the paper feed tray 44. That is, the foreign object determination portion 113 determines the presence or absence of the foreign object on the paper feed tray 44. Examples of the foreign object determined by the foreign object determination portion 113 include an object unintentionally put on the upper surface of the document sheet G on the paper feed tray 44, an object left behind as temporarily put on the document sheet G, an object owned by a user or the like around the image forming apparatus 100 and fallen to reach the paper feed tray 44, and the like. Various objects are possible as specific examples of the foreign object. Examples of the foreign object include objects each having a certain size such as stationery including a pen, a clip, and the like and accessories including glasses, a watch, and the like worn by a user. It is to be noted that the foreign object determination portion 113 is capable of determining even an object out of contact with the document sheet G and located above the document sheet G. For example, in a case where a hand or a finger of a user is present within the detection range of the flip-up detection sensor 28 above the document sheet G, the hand or the finger is also an example of the foreign object to be determined.

Specifically, while the first raising and lowering processing portion 111 is raising the paper feed tray 44 from the initial position (the position shown in FIG. 3), the foreign object determination portion 113 determines the presence or absence of the foreign object other than the document sheet G on the paper feed tray 44 on the basis of an output signal of the flip-up detection sensor 28. If described in detail, in a case where a sense signal from the flip-up detection sensor 28 is the ON-signal or in a case where the sense signal changes from the OFF-signal to the ON-signal, the foreign object determination portion 113 determines that the foreign object other than the document sheet G is present on the paper feed tray 44. In this embodiment, while the paper feed tray 44 is being raised, the foreign object determination portion 113 acquires a sense signal from the flip-up detection sensor 28. In a case where this sense signal is the ON-signal, the foreign object determination portion 113 determines that the foreign object is present on the paper feed tray 44. In a case where the sense signal remains the OFF-signal, the foreign object determination portion 113 determines that the foreign object is not present on the paper feed tray 44.

In a case where the foreign object determination portion 113 determines that the foreign object is present on the paper feed tray 44, the first raising and lowering processing portion 111 stops raising the paper feed tray 44.

In this case, the foreign object determination portion 113 may determine that the foreign object is present on the paper feed tray 44 in a case where the ON-signal continues for a first setting time T1 defined in advance after the sense signal of the flip-up detection sensor 28 changes from the OFF-signal to the ON-signal.

It is to be noted that the first raising and lowering processing portion 111 may resume raising the paper feed tray 44 in a case where the sense signal of the flip-up detection sensor 28 returns to the original output value (OFF-signal) within a second setting time T2 defined in advance after the foreign object determination portion 113 determines that the foreign object is present on the paper feed tray 44.

While the sheet feed mechanism 31 is conveying the document sheet G, the flip-up determination portion 114 determines that the document sheet G being conveyed is abnormal on the basis that the sense signal of the flip-up detection sensor 28 changes. Specifically, when the sheet feed mechanism 31 conveys the document sheet G after the paper feed tray 44 is raised to the initial position, the flip-up determination portion 114 acquires a sense signal from the flip-up detection sensor 28 immediately after the conveyance. In a case where this sense signal changes from the OFF-signal to the ON-signal, the flip-up determination portion 114 determines that the conveyed document sheet G is flipping up (abnormal state). It is to be noted that, in a case where a sense signal from the flip-up detection sensor 28 remains the OFF-signal, the flip-up determination portion 114 determines that the document sheet G is not flipping up (normal state).

In a case where the foreign object determination portion 113 determines that the foreign object is present on the paper feed tray 44, the output processing portion 115 outputs foreign object error information indicating that the foreign object is present on the paper feed tray 44 to the display operation portion of the image forming apparatus 100, an external output destination terminal, or the like. In addition, in a case where the flip-up determination portion 114 determines that the document sheet G being conveyed from the paper feed tray 44 is abnormal, document sheet abnormality error information indicating that the document sheet G is abnormal is output to the display operation portion of the image forming apparatus 100, the external output destination terminal, or the like.

The second raising and lowering processing portion 112 calculates the quantity of document sheets G loaded onto the sheet discharge tray 43 on the basis of a signal acquired from the discharged document sheet sensor 21 and raises the discharge guide portion 66 depending on the calculated quantity of loaded document sheets G.

In this embodiment, the second raising and lowering processing portion 112 raises and lowers the discharge guide portion 66 between a lowermost position P1 (the position shown in FIG. 3) and a dischargeable position P2 (the position shown in FIG. 5). In addition, the second raising and lowering processing portion 112 performs control to lower the discharge guide portion 66 to the lowermost position P1 and make the discharge guide portion 66 stand by at the position when an execution signal is not received that causes a document sheet on the paper feed tray 44 to be conveyed. In addition, in a case where a predetermined condition is satisfied, the second raising and lowering processing portion 112 performs control to move the discharge guide portion 66 from the lowermost position P1 to the dischargeable position P2 defined above the lowermost position P1. Positional information regarding each of the positions P1 and P2 described above is stored, for example, in the storage portion 104 of the control portion 2.

Here, the lowermost position P1 is the initial position at which the discharge guide portion 66 is disposed before the document sheet G is conveyed. Specifically, the lowermost position P1 is the position at which the discharge port 69 has the lowest position within the movement range of the discharge guide portion 66 in the up-down direction. The lowermost position P1 is a position that allows the document sheet G to be discharged to the sheet discharge tray 43 with no disorder in a case where a document sheet is conveyed with the document sheet G not loaded onto the sheet discharge tray 43.

In addition, the dischargeable position P2 is a position that allows the document sheet G to be discharged to the sheet discharge tray 43. The dischargeable position P2 is a position at which the document sheet G may be appropriately discharged to the sheet discharge tray 43 with no disorder. The dischargeable position P2 is a position at which the difference between the discharge port 69 and the upper surface of the document sheet G loaded onto the sheet discharge tray 43 has a preset value defined in advance. For example, the dischargeable position P2 is a position at which the discharge port 69 is higher than the height position of the upper surface of the document sheet G by a preset length (e.g., 10 mm). In this embodiment, the position of the discharge guide portion 66 at which an output signal of the discharged document sheet sensor 21 changes from the ON-signal to the OFF-signal is the dischargeable position P2.

In a case where a predetermined trigger signal is detected, the second raising and lowering processing portion 112 decides the dischargeable position P2 of the discharge guide portion 66 corresponding to the quantity of document sheets G (or the height position of the upper surface of the document sheets G) loaded onto the sheet discharge tray 43. The second raising and lowering processing portion 112 then performs control to raise the discharge guide portion 66 toward the dischargeable position P2 from the lowermost position P1. When the discharge guide portion 66 reaches the dischargeable position P2, the second raising and lowering processing portion 112 then stops raising the discharge guide portion 66 and disposes the discharge guide portion 66 at the dischargeable position P2.

The trigger signal is, for example, a document sheet sense signal obtained by sensing that the document sheet G to be conveyed is placed on the paper feed tray 44, a setting input signal indicating that various settings (such as the setting of the reading surface, the setting of the number of sets, and the setting of image quality) to be input before an image reading process is performed on the document sheet G for the image forming apparatus 100 are input to the image forming apparatus 100 or the display operation portion, an execution signal indicating that an image reading instruction or an image forming instruction for the document sheet G is input to the image forming apparatus 100 or the display operation portion, or the like.

Abnormality Determination Process (Processing Example 1)

Figure 7:
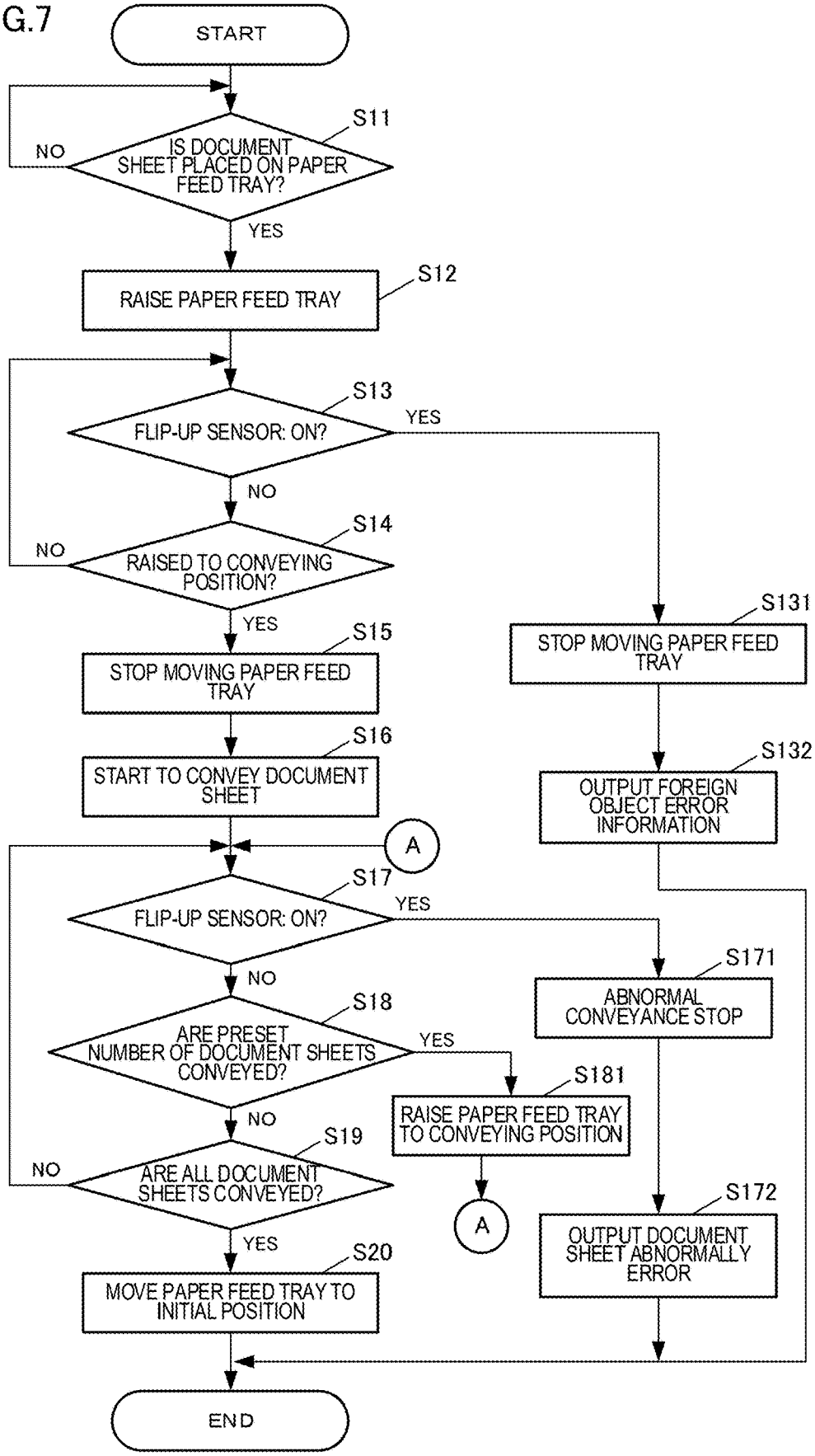
FIG. 7 is a flowchart showing an example of a procedure of an abnormality determination process that is executed by a control portion of the document sheet conveying device.

An example of a procedure of an abnormality determination process that is executed by the control portion 2 will be described below with reference to the flowchart of FIG. 7. In the flowchart of each diagram, steps S11, S12, . . . represent processing procedure (step) numbers. The following description assumes that the abnormality determination process is executed in a case where the document sheet conveying device 120 conveys the document sheet G in an image reading process on the document sheet G. In addition, the following assumes that the paper feed tray 44 is disposed at the initial position and the discharge guide portion 66 is disposed at the lowermost position P1 before the document sheet G is conveyed. Furthermore, the following description assumes that the document sheet G is placed on the paper feed tray 44.

It is to be noted that the respective steps in the abnormality determination process may be executed in different order as long as similar working effects are attained.

In addition, in a case where the control portion 2 includes not only the CPU 101, but also, for example, a plurality of CPUs, the respective steps in the abnormality determination process may be distributed to the plurality of CPUs and executed by the plurality of CPUs.

In addition, this disclosure can be understood as the invention of a method in which the one or more steps included in the abnormality determination process are executed by the CPU 101 of the control portion 2 or another processor. Furthermore, this disclosure can also be understood as a program for causing the CPU 101 of the control portion 2 or another processor to execute the respective steps.

First, in step S11, the control portion 2 determines whether or not the document sheet G is placed on the paper feed tray 44. For example, it is determined on the basis of a document sheet sense signal output from the document sheet detection sensor 29 in a case where the document sheet G is placed on the paper feed tray 44 whether or not the document sheet G is placed on the paper feed tray 44. In a case where the document sheet sense signal is the ON-signal, the control portion 2 determines that the document sheet G is placed on the paper feed tray 44. It is to be noted that the determination process of step S11 is a process of deciding the start timing of the abnormality determination process. For example, it is also possible to use the setting input signal, the execution signal, or the like as the start timing.

In next step S12, the control portion 2 raises the paper feed tray 44 from the initial position when acquiring the ON-signal from the document sheet detection sensor 29.

The control portion 2 determines whether or not to receive the ON-signal from the flip-up detection sensor 28 while the paper feed tray 44 is being raised (S13). In a case where the ON-signal is acquired from the flip-up detection sensor 28 while the paper feed tray 44 is being raised, the control portion 2 determines that a foreign object is present on the paper feed tray 44 and stops moving up the paper feed tray 44 (S131). After that, the foreign object error information indicating that a foreign object is present on the paper feed tray 44 is output (S132) and the series of abnormality determination processes ends.

In a case where the control portion 2 does not acquire the ON-signal from the flip-up detection sensor 28, but is continuously receiving the OFF-signal while the paper feed tray 44 is being raised, the control portion 2 determines that no foreign object is present on the paper feed tray 44 and continues moving up the paper feed tray 44.

The control portion 2 then stops moving up the paper feed tray 44 when the paper feed tray 44 is raised to the conveying position (S14). This causes the document sheet G on the paper feed tray 44 to enter a conveyable state. In this state, the sheet feed mechanism 31 starts to convey the document sheet G (S16).

When the document sheet G starts to be conveyed, the control portion 2 determines whether or not to receive the ON-signal from the flip-up detection sensor 28 while the document sheet G is being conveyed (S17). In a case where the ON-signal is acquired from the flip-up detection sensor 28 while the document sheet G is being conveyed, the control portion 2 determines the abnormal state in which the rear end of the document sheet G being conveyed is flipping up and stops conveying the document sheet G (S171). After that, the document sheet abnormality error information indicating that the document sheet G is in the abnormal state is output (S172) and the series of abnormality determination processes ends.

In a case where the control portion 2 does not acquire the ON-signal from the flip-up detection sensor 28, but is continuously receiving the OFF-signal while the document sheet G is being conveyed, the control portion 2 determines that the document sheet G has no abnormality and continues conveying the document sheet G.

In next step S18, it is determined whether or not a preset number of document sheets G defined in advance are conveyed. The control portion 2 counts the number of times the document sheets G are conveyed whenever the document sheets G are conveyed and stores the count value as the number of conveyed documents sheets. When a preset number of document sheets G are conveyed, the upper surface of the document sheets G on the paper feed tray 44 relatively decreases by the preset number of document sheets G. Therefore, when a preset number of document sheets G are conveyed, the control portion 2 raises the paper feed tray 44 to the conveying position (S181) and then executes step S17 and the subsequent steps repeatedly.

When the document sheets G on the paper feed tray 44 are all conveyed before a preset number of document sheets G are conveyed (S19), the control portion 2 returns the paper feed tray 44 to the initial position (S20) and ends the series of abnormality determination processes.

As described above, the control portion 2 in the image forming apparatus 100 according to this embodiment determines whether or not to receive the ON-signal from the flip-up detection sensor 28 while the paper feed tray 44 is being raised (S13). In a case where the ON-signal is received from the flip-up detection sensor 28, the control portion 2 determines that a foreign object is present on the paper feed tray 44 and then stops moving up the paper feed tray 44 (S131). This prevents the foreign object from being caught in the housing of the document sheet conveying device 120 such as the cover portion 46 or the frame and prevents the housing from being damaged when the paper feed tray 44 is raised. In addition, the foreign object is prevented from entering the sheet feed mechanism 31, the conveying mechanism 32, the discharge mechanism 36, or the like in a process of conveying the document sheet G from the paper feed tray 44. In addition, the foreign object is prevented from entering, from the opening 40A or the opening 61A, the inside of the scanner 110 below.

In addition, in a case where the ON-signal is acquired from the flip-up detection sensor 28 while the document sheet G is being conveyed, the control portion 2 determines the abnormal state in which the rear end of the document sheet G being conveyed is flipping up and stops conveying the document sheet G (S171). The rear end of the document sheet G flips up chiefly because the rear end of the document sheet G is bound by a binding tool such as the staple. The quick detection of the abnormal state of the document sheet G and a stop of the conveyance of the document sheet G thus prevent, for example, the document sheet G from being damaged, prevent a paper jam in the document sheet conveying device 120, and prevent the staple from damaging each of the rollers.

In addition, an output signal of the flip-up detection sensor 28 is used for the determination process on the presence or absence of a foreign object on the paper feed tray 44 and the determination process on the abnormal state of the document sheet G to be conveyed. That is, the flip-up detection sensor 28 is used for both the respective determination processes. In the image forming apparatus 100 according to this embodiment, it is therefore possible to execute the respective determination processes without providing any individual sensors that execute the respective determination processes.

Abnormality Determination Process (Processing Example 2)

Figure 8:
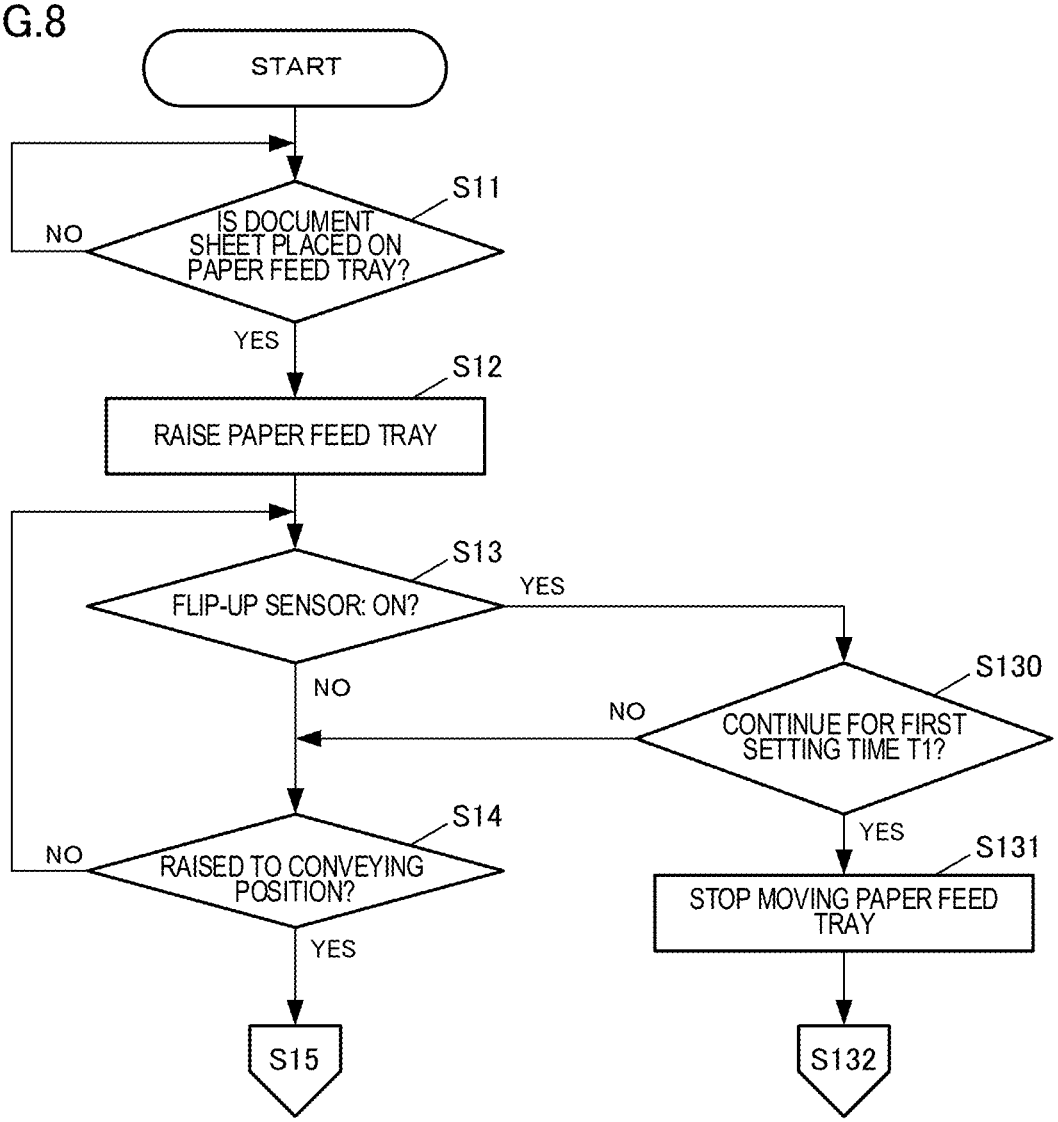
FIG. 8 is a flowchart showing another example of a procedure of a raising and lowering control process of the abnormality determination process that is executed by the control portion of the document sheet conveying device.

As another embodiment of this disclosure, the control portion 2 may execute an abnormality determination process in accordance with the flowchart shown in FIG. 8. It is to be noted that the same process as the abnormality determination process shown in FIG. 7 will not be described.

For example, in a case where the ON-signal is acquired from the flip-up detection sensor 28 in step S13 described above while the paper feed tray 44 is being raised, the paper feed tray 44 does not immediately stop being raised, but it may be determined whether or not the ON-signal is continuously output for the first setting time T1 defined in advance (S130) and it may be determined that the foreign object is present on the paper feed tray 44 in a case where the ON-signal is continuously output for the first setting time T1. In a case where the ON-signal is continuously output for the first setting time T1, the control portion 2 stops moving up the paper feed tray 44 (S131).

Abnormality Determination Process (Processing Example 3)

Figure 9:
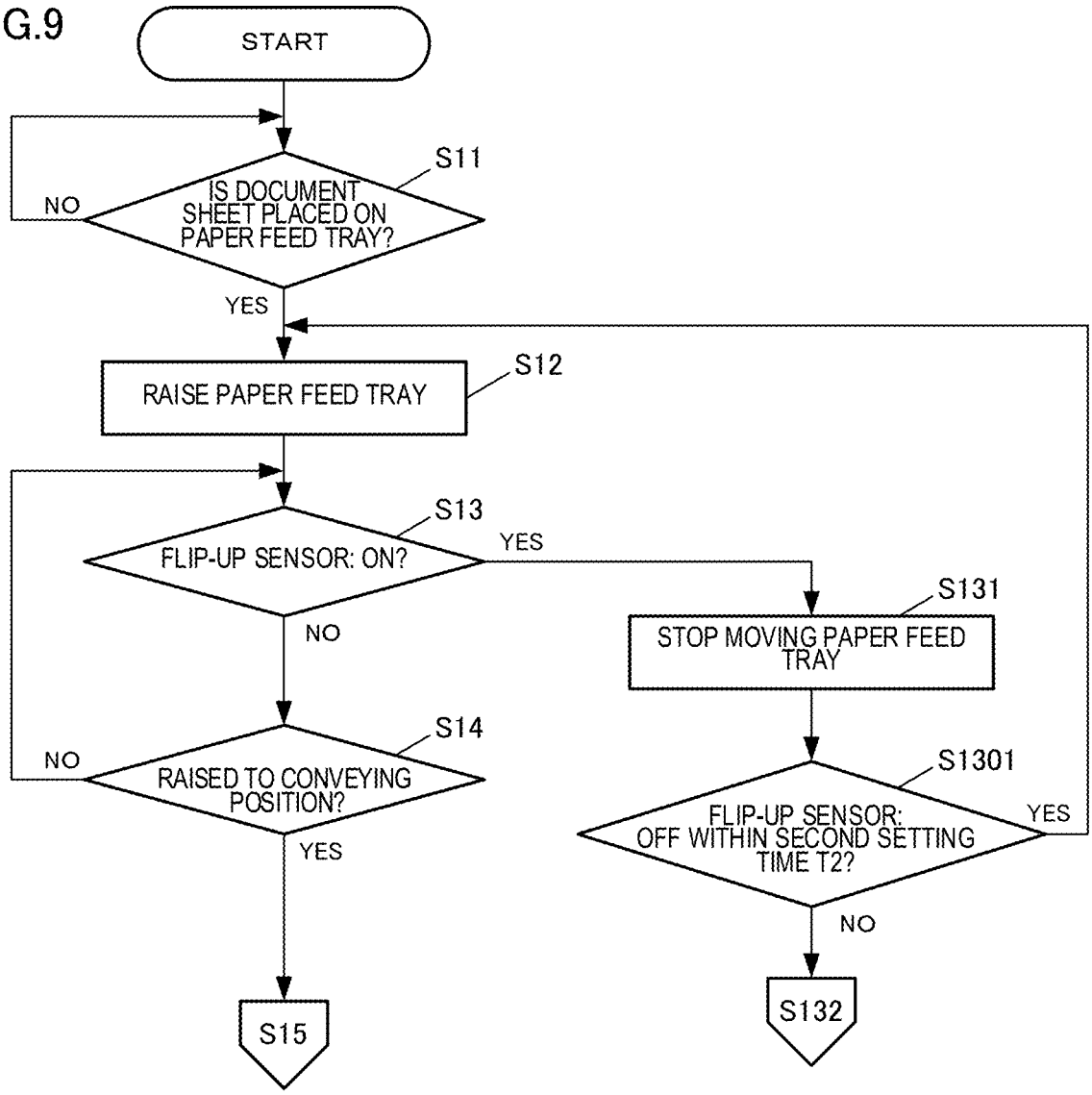
FIG. 9 is a flowchart showing still another example of the procedure of the raising and lowering control process of the abnormality determination process that is executed by the control portion of the document sheet conveying device.

As still another embodiment of this disclosure, the control portion 2 may execute an abnormality determination process in accordance with the flowchart shown in FIG. 9. It is to be noted that the same process as the abnormality determination process shown in FIG. 7 will not be described.

For example, in a case where the ON-signal is acquired from the flip-up detection sensor 28 in step S13 described above while the paper feed tray 44 is being raised, the control portion 2 stops raising the paper feed tray 44 (S131). After that, the control portion 2 determines whether or not a sense signal of the flip-up detection sensor 28 returns to the OFF-signal from the ON-signal within the second setting time T2 defined in advance before the foreign object error information is output (S1301). In a case where the sense signal does not return to the OFF-signal from the ON-signal in step S1301, the control portion 2 may determine that the foreign object is present on the paper feed tray 44. In contrast, in a case where the sense signal returns to the OFF-signal from the ON-signal in step S1301, the control portion 2 considers it erroneous detection, determines that the foreign object is not present on the paper feed tray 44, returns to step S12, and raises the paper feed tray 44 again.

SUPPLEMENTARY NOTES OF INVENTION

The gist of the invention extracted from the embodiments described above will be supplementarily noted below. It is to be noted that the respective configurations and the respective processing functions described in the following supplementary notes can be sorted out and used in any combination.

Supplementary Note 1

A sheet conveying device including:

a conveying tray onto which a sheet is loaded;

a conveying mechanism configured to convey the sheet along a conveyance path extending from the conveying tray to a discharge tray;

a raising and lowering mechanism including a drive portion configured to raise and lower the conveying tray in an up-down direction;

a raising and lowering control portion configured to drive the drive portion and control raising and lowering of the conveying tray;

a sensor configured to detect that a downstream end of a sheet in a conveying direction flips up, the sheet being conveyed from the conveying tray;

a first determination processing portion configured to determine on the basis of an output signal of the sensor whether or not a foreign object other than the sheet is present on the conveying tray while the raising and lowering control portion is raising the conveying tray before the conveying mechanism conveys the sheet; and a second determination processing portion configured to determine, on the basis that the output signal of the sensor changes while the conveying mechanism is conveying the sheet, that the sheet being conveyed is abnormal.

Supplementary Note 2

The sheet conveying device according to Supplementary Note 1, in which the raising and lowering control portion stops raising the conveying tray in a case where the first determination processing portion determines that the foreign object is present on the conveying tray.

Supplementary Note 3

The sheet conveying device according to Supplementary Note 2, in which the raising and lowering control portion resumes raising the conveying tray in a case where an output value of the output signal of the sensor returns to an original output value within a first setting time after the first determination processing portion determines that the foreign object is present on the conveying tray, the first setting time being defined in advance.

Supplementary Note 4

The sheet conveying device according to any of Supplementary Notes 1 to 3, in which the first determination processing portion determines that the foreign object is present on the conveying tray in a case where an output value of the output signal continues for a second setting time after the output signal changes, the second setting time being defined in advance.

Supplementary Note 5

The sheet conveying device according to any of Supplementary Notes 1 to 4, further including an output processing portion configured to output error information in a case where the first determination processing portion determines that the foreign object is present on the conveying tray, the error information indicating that the foreign object is present on the conveying tray.

Supplementary Note 6

An image processing apparatus including:

the sheet conveying device according to any of Supplementary Notes 1 to 5; and an image processing portion configured to perform an image process on a sheet that is conveyed by the sheet conveying device.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a conveying tray onto which a sheet is loaded;

a conveying mechanism configured to convey the sheet along a conveyance path extending from the conveying tray to a discharge tray;

a raising and lowering mechanism including a drive portion configured to raise and lower the conveying tray in an up-down direction;

a raising and lowering control portion configured to drive the drive portion and control raising and lowering of the conveying tray;

a sensor configured to detect that a downstream end of a sheet in a conveying direction flips up, the sheet being conveyed from the conveying tray;

a first determination processing portion configured to determine on a basis of an output signal of the sensor whether or not a foreign object other than the sheet is present on the conveying tray while the raising and lowering control portion is raising the conveying tray before the conveying mechanism conveys the sheet; and a second determination processing portion configured to determine, on a basis that the output signal of the sensor changes while the conveying mechanism is conveying the sheet, that the sheet being conveyed is abnormal, wherein the raising and lowering control portion stops raising the conveying tray in a case where the first determination processing portion determines that the foreign object is present on the conveying tray, and wherein the raising and lowering control portion resumes raising the conveying tray in a case where an output value of the output signal of the sensor returns to an original output value within a first setting time after the first determination processing portion determines that the foreign object is present on the conveying tray, the first setting time being defined in advance.

2. The sheet conveying device according to claim 1, wherein the first determination processing portion determines that the foreign object is present on the conveying tray in a case where the output value of the output signal continues for a second setting time after the output signal changes, the second setting time being defined in advance.

3. The sheet conveying device according to claim 1, further comprising an output processing portion configured to output error information in the case where the first determination processing portion determines that the foreign object is present on the conveying tray, the error information indicating that the foreign object is present on the conveying tray.

4. An image processing apparatus comprising:

the sheet conveying device according to claim 1; and an image processing portion configured to perform an image process on a sheet that is conveyed by the sheet conveying device.

* * * * *